US007486023B2

(12) United States Patent
Song

(10) Patent No.: US 7,486,023 B2
(45) Date of Patent: Feb. 3, 2009

(54) SINGLE LAYER DISCHARGE ELECTRODE CONFIGURATION FOR A PLASMA DISPLAY PANEL

(75) Inventor: Jung-Suk Song, Suwon-si (KR)

(73) Assignee: Samsung SDI Co., Ltd, Yeongtong-Gu, Suwon-Si, Gyeonggi-Do (KR)

( * ) Notice: Subject to any disclaimer, the term of this patent is extended or adjusted under 35 U.S.C. 154(b) by 0 days.

(21) Appl. No.: 11/206,250

(22) Filed: Aug. 17, 2005

(65) Prior Publication Data

US 2006/0038494 A1 Feb. 23, 2006

(30) Foreign Application Priority Data

Aug. 18, 2004 (KR) ..... 10-2004-0065037

(51) Int. Cl.
*H01J 17/49* (2006.01)

(52) U.S. Cl. ..... 313/587; 313/582; 313/292

(58) Field of Classification Search ..... 313/582–587, 313/292; 345/60

See application file for complete search history.

(56) References Cited

U.S. PATENT DOCUMENTS

| | | | | |
|---|---|---|---|---|
| 5,744,909 | A * | 4/1998 | Amano | 313/585 |
| 2004/0164677 | A1* | 8/2004 | Lee | 313/582 |
| 2004/0245929 | A1* | 12/2004 | Sakamoto | 313/584 |
| 2005/0029944 | A1* | 2/2005 | Kwon et al. | 313/583 |
| 2005/0116646 | A1* | 6/2005 | Yoo et al. | 313/582 |
| 2005/0264198 | A1* | 12/2005 | Woo et al. | 313/582 |
| 2006/0158112 | A1* | 7/2006 | Hur et al. | 313/582 |

FOREIGN PATENT DOCUMENTS

JP 08-045433 2/1996

(Continued)

OTHER PUBLICATIONS

Notice to Submit Response issued on Mar. 29, 2006 by the Korean Intellectual Property Office in Korean Application No. 10-2004-0065037.

(Continued)

*Primary Examiner*—Toan Ton
*Assistant Examiner*—Hana A Sanei
(74) *Attorney, Agent, or Firm*—Knobbe Martens Olson & Bear LLP

(57) ABSTRACT

A plasma display panel having discharge electrodes of a particular arrangement and structure is disclosed. In one aspect, the plasma display panel includes a front substrate; a rear substrate facing the front substrate; a dielectric wall disposed between the front and rear substrates and defining discharge cells with the front and rear substrates; an X electrode embedded within the dielectric wall and disposed to span a first corner of the discharge cell; a Y electrode embedded within the dielectric wall and disposed to span a second corner of the discharge cell that is opposite the first corner; an address electrode embedded within the dielectric layer and disposed in a direction crossing the Y electrode; and red, green, and blue phosphor layers applied in the discharge cells. Since the Y electrode and the address electrode are positioned to be adjacent to each other, the distance between the electrodes is reduced, and low voltage operation and high speed addressing can be achieved.

10 Claims, 7 Drawing Sheets

FOREIGN PATENT DOCUMENTS

| | | |
|---|---|---|
| JP | 2002-170493 | 6/2002 |
| JP | 2002-289103 | 10/2002 |
| JP | 2003-257321 | 9/2003 |
| JP | 2005-209637 | 8/2005 |
| KR | 10-0378618 | 3/2003 |
| WO | WO 03032356 A1 * | 4/2003 |

OTHER PUBLICATIONS

Japanese Office Action dated Oct. 21, 2008 for JP 2005-232614.

* cited by examiner

SINGLE LAYER DISCHARGE ELECTRODE CONFIGURATION FOR A PLASMA DISPLAY PANEL

CROSS-REFERENCE TO RELATED APPLICATIONS

This application claims the benefit of Korean Patent Application No. 10-2004-0065037, filed on Aug. 18, 2004, in the Korean Intellectual Property Office, the disclosure of which is incorporated herein in its entirety by reference.

BACKGROUND OF THE INVENTION

1. Field of the Invention

The present invention relates to a plasma display panel, and more particularly, to a discharge electrode which improves addressing speed by embedding the discharge electrodes which generate address discharges in the discharge cells within a dielectric layer.

2. Description of the Related Art

In general, a plasma display panel is a flat panel display device, in which a discharge gas is injected between two substrates having a plurality of discharge electrodes to generate discharge, wherein phosphor layers are excited by ultraviolet rays generated due to the discharge, thereby displaying desired numbers, characters, and images.

FIG. 1 (PRIOR ART) shows a three-electrode surface discharge type plasma display panel 100.

Referring to FIG. 1, the plasma display panel 100 includes a front substrate 110, a rear substrate 150 facing the front substrate 110, an X electrode 121 and a Y electrode 122 disposed on an inner surface of the front substrate 110, a front dielectric layer 130 covering the X and Y electrodes 121 and 122, a protective layer 140 coated on the front dielectric layer 130, an address electrode 160 formed on an inner surface of the rear substrate 150, a rear dielectric layer 170 covering the address electrode 160, a barrier rib 180 disposed between the front and rear substrates 110 and 150, and red, green, or blue phosphor layers 190 formed in the barrier ribs 180. The X electrode 121 includes a first transparent electrode line 121*a*, and a first bus electrode line 121*b* formed on the first transparent electrode line 121*a*. The Y electrode 122 includes a second transparent electrode line 122*a*, and a second bus electrode line 122*b* formed on the second transparent electrode line 122*a*.

In the plasma display panel 100 including the above structure, an electric signal is applied to the Y electrode 122 and the address electrode 160 to select a discharge cell, an electric signal is applied alternately to the X and Y electrodes 121 and 122 to generate a surface discharge from the inner surface of the front substrate 110 and to generate ultraviolet rays. Visible light is emitted from the phosphor layer 190 in the selected discharge cell to display a still image or a moving picture.

However, the conventional plasma display panel 100 includes the following problems.

First, the discharge starts from a discharge gap between the X electrode 121 and the Y electrode 122, is distributed to the outer portions of the X and Y electrodes 121 and 122. Since the discharge diffuses in the plane of the front substrate 110, space usage of the discharge cell is low.

Second, when a high concentration Xe gas (about 10% by volume or more) is injected into the discharge cell, ionization and excitation of the electrons causes generation of excitons, and thus, the brightness and the discharge efficiency increase. However, since a high concentration Xe gas is used, initial discharge firing voltage becomes high.

Third, since the X electrode 121, Y electrode 122, the bus electrode 123, and the protective layer 140 are formed on the inner surface of the front substrate 110, the transmittance of the visible light is typically less than about 60%. Therefore, the brightness is low.

Fourth, if the plasma display panel 100 is driven for a long time, the discharge diffuses toward the phosphor layer 190. Accordingly, the charged particles of the discharge gas are sputtered onto the phosphor layer, and cause a permanent residual image to be displayed.

SUMMARY OF CERTAIN INVENTIVE EMBODIMENTS

One inventive aspect is a plasma display panel comprising discharge electrodes of improved structure, wherein the panel comprises: a front substrate, a rear substrate facing the front substrate, a dielectric wall positioned between the front and rear substrates and defining discharge cells with the front and rear substrates, an X electrode embedded within the dielectric wall and positioned to span a first corner of one of the discharge cells, a Y electrode embedded within the dielectric wall and positioned to span a second corner of one of the discharge cells, the second corner being opposite the first corner, an address electrode embedded within the dielectric layer, and positioned so as to cross the Y electrode, and red, green, or blue phosphor layers applied in each of the discharge cells.

The X electrode may extend in a predetermined direction, and the Y electrode may extend in a direction parallel to a side of the discharge cell and to the X electrode.

The X electrode may comprise an X electrode line and an X electrode protrusion protruding from the X electrode line toward the Y electrode.

The Y electrode may comprise a Y electrode line, and a Y electrode protrusion protruding from the Y electrode line toward the X electrode.

The X and Y electrodes each may be substantially formed in the shape of a comb and the protrusions of each may be interleaved with the protrusions of the other.

The address electrode may be parallel to the Y electrode protrusion.

The address electrode may comprise an address electrode protrusion parallel to the Y electrode line.

The address electrode may have the general shape of a comb and may cross the Y electrode.

The X and Y electrodes may be positioned substantially within the same plane, and the address electrode may be positioned substantially within a second plane separate from and parallel to the first plane and the address electrode may be positioned substantially adjacent to the X and Y electrodes.

A first part of the address electrode may have a smaller volume than that of another part.

The address electrode may be formed so that a cross-sectional area of the address electrode is larger at the center of the panel than at the edges.

A barrier rib may be formed in a shape corresponding to the dielectric wall between the dielectric wall and the rear substrate, wherein the phosphor layer may be inside of the barrier rib.

A protective layer may further be formed on an inner surface of the dielectric wall in order to increase emission of secondary electrons.

BRIEF DESCRIPTION OF THE DRAWINGS

The above and other features and advantages of certain inventive aspects are discussed with further detailed exemplary embodiments with reference to the attached drawings in which.

DETAILED DESCRIPTION OF CERTAIN INVENTIVE EMBODIMENTS

Certain inventive embodiments will now be described more fully with reference to the accompanying drawings, in which exemplary embodiments are shown.

Figure 1:
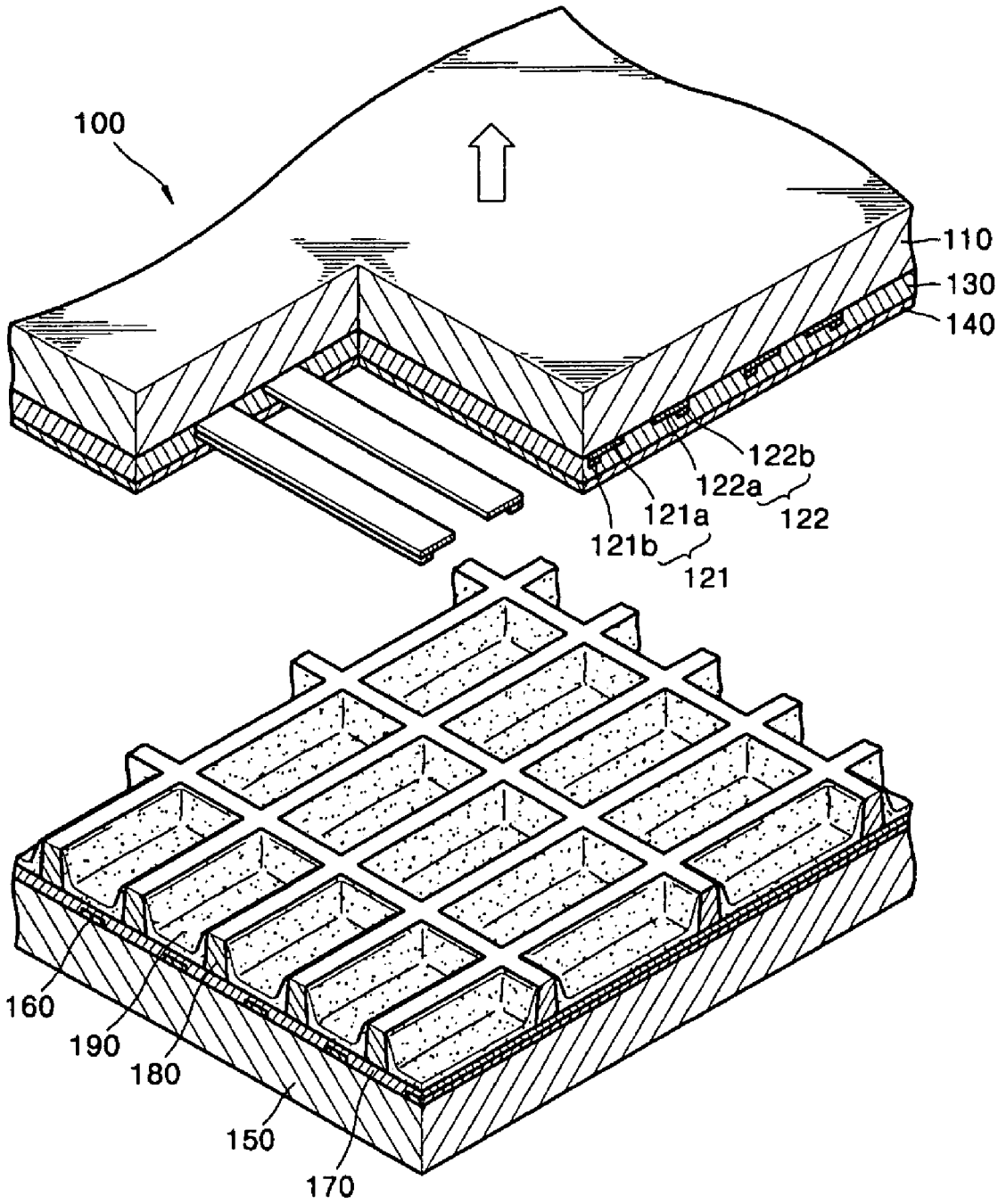
FIG. 1 (PRIOR ART)
FIG. 1 (PRIOR ART) is an exploded perspective view of a conventional plasma display panel.
Figure 2:
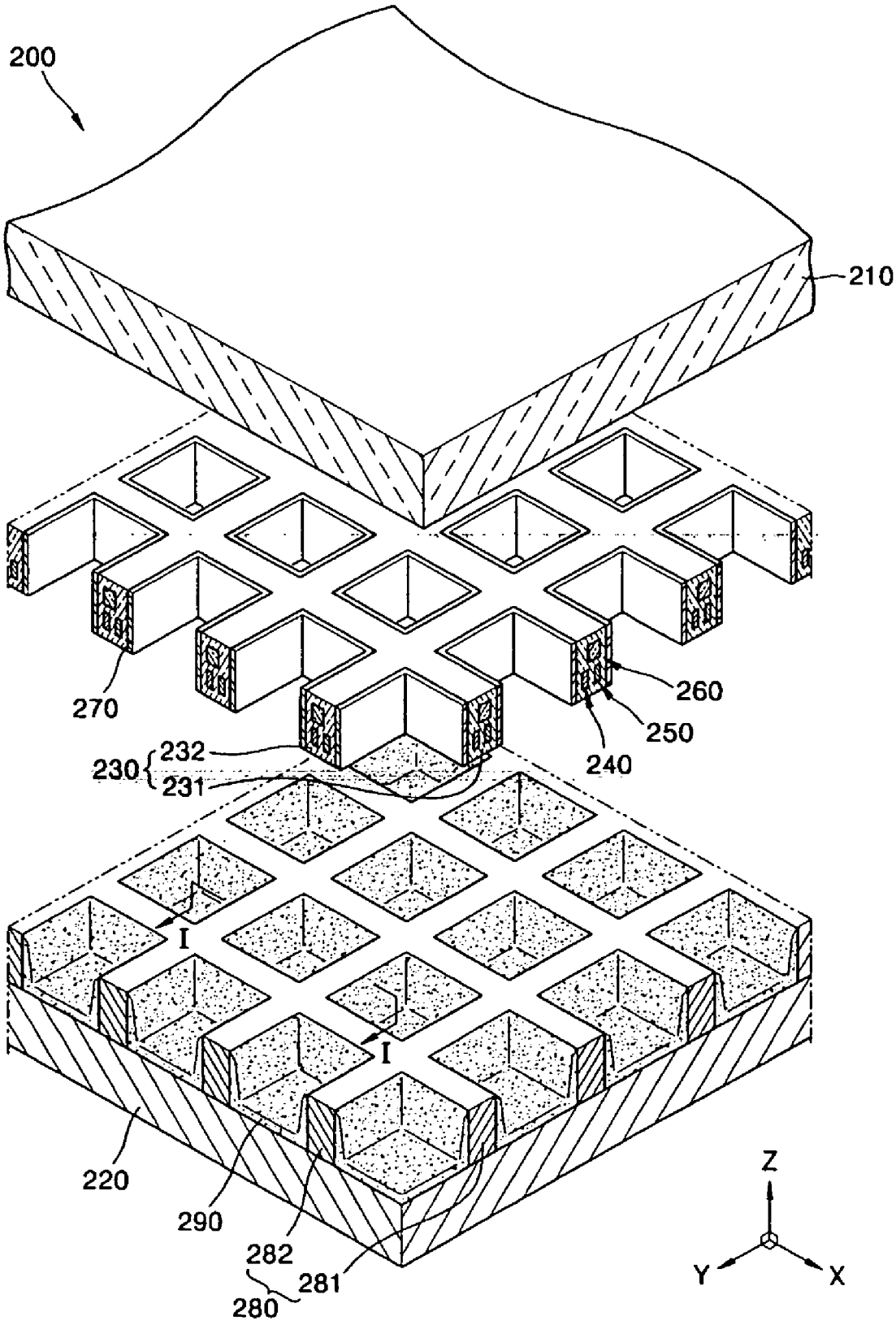
FIG. 2 is an exploded perspective view of a plasma display panel according to an embodiment.

FIG. 2 is an exploded perspective view of a part of a plasma display panel 200 according to an embodiment.

Referring to FIG. 2, the plasma display panel 200 includes a front substrate 210, and a rear substrate 220 disposed parallel to the front substrate 210. On the inner surfaces of the front substrate 210 and the rear substrate 220 facing each other, frit glass is applied along the outer edges to seal the inner space.

The front substrate 210 is formed of a transparent material, for example, soda lime glass. The rear substrate 220 may be formed of the same material as that of the front substrate 210.

A dielectric wall 230 is disposed between the front substrate 210 and the rear substrate 220 to define discharge cells with the front and rear substrates 210 and 220. The dielectric wall 230 is formed by adding various fillers to the glass paste.

The dielectric wall 230 includes a first set of dielectric walls such as dielectric wall 231 disposed in an X direction of the panel 200, and a second set of dielectric walls such as dielectric wall 232 disposed in a Y direction of the panel 200. The first and second sets of dielectric walls intersect to define discharge cells of a lattice.

Alternatively, the dielectric wall 230 can be formed in various other configurations, such as, but not limited to a irregular shape, a delta shape, a hexagon shape, or a honeycomb shape. In addition, the discharge cell defined by the dielectric wall 230 can be formed in other polygon shapes, or circular shapes. An X electrode 240, a Y electrode 250, and an address electrode 260 are embedded within the dielectric wall 230. The X electrode 240, the Y electrode 250, and the address electrode 260 are positioned along the perimeter of the discharge cell. In addition, since the X electrode 240, the Y electrode 250, and the address electrode 260 are electrically insulated from each other, different voltages can be applied to each of them.

A protective layer 270, which may be formed of MgO, is deposited on inner surfaces of the dielectric wall 230 so as to emit secondary electrons. The protective layer 270 is applied to each discharge cell.

Barrier ribs 280 are formed between the dielectric wall 230 and the rear substrate 220. The barrier rib 280 is formed of a low dielectric material, unlike the dielectric wall 230. The barrier rib 280 is formed in the same shape as the dielectric wall 230 at a position corresponding to the dielectric wall 230.

The barrier rib 280 includes a first set of barrier ribs, such as barrier rib 281 which correspond to the first set of dielectric walls (X direction), and a second set of barrier ribs such as barrier rib 282 which correspond to the second set of dielectric walls (Y direction). The first and second sets of barrier ribs are coupled integrally to each other to form a lattice.

If only the dielectric wall 230 is formed between the front and rear substrates 210 and 220, the discharge cells are defined by the dielectric wall only. If both the dielectric wall 230 and the barrier rib 280 are formed between the front and rear substrates 210 and 220, the discharge cells are defined by both of these walls, which are formed of materials having different dielectric properties.

A discharge gas such as Ne—Xe or He—Xe is injected into the discharge cell defined by the front substrate 210, the rear substrate 220, the dielectric wall 230, and the barrier rib 280.

In addition, red, green, or blue phosphor layers 290 that are excited by ultraviolet radiation generated due to the discharge gas are formed in the discharge cells. The phosphor layer 290 can be applied anywhere in the discharge cell. In some embodiments, the phosphor layer 290 is applied to the inner walls of the barrier rib 280 and to an upper surface of the discharge cell to a predetermined thickness.

The red, green, or blue phosphor layer 290 is coated on each discharge cell. The red phosphor layer may be formed of $(Y,Gd)BO_3:Eu^{+3}$, the green phosphor layer may be formed of $Zn_2SiO_4:Mn^{2+}$, and the blue phosphor layer may be formed of $BaMgAl_{10}O_{17}:Eu^{2+}$.

In the embodiment of FIG. 2 with reference to a single discharge cell the X electrode 240 and the Y electrode 250 are positioned on opposite sides of the discharge cell and the address electrode 260 is positioned on the same side of the discharge cell as the Y electrode 250 and closer to the front substrate 210.

Arrangement of the electrodes will be described in more detail as follows.

Figure 3:
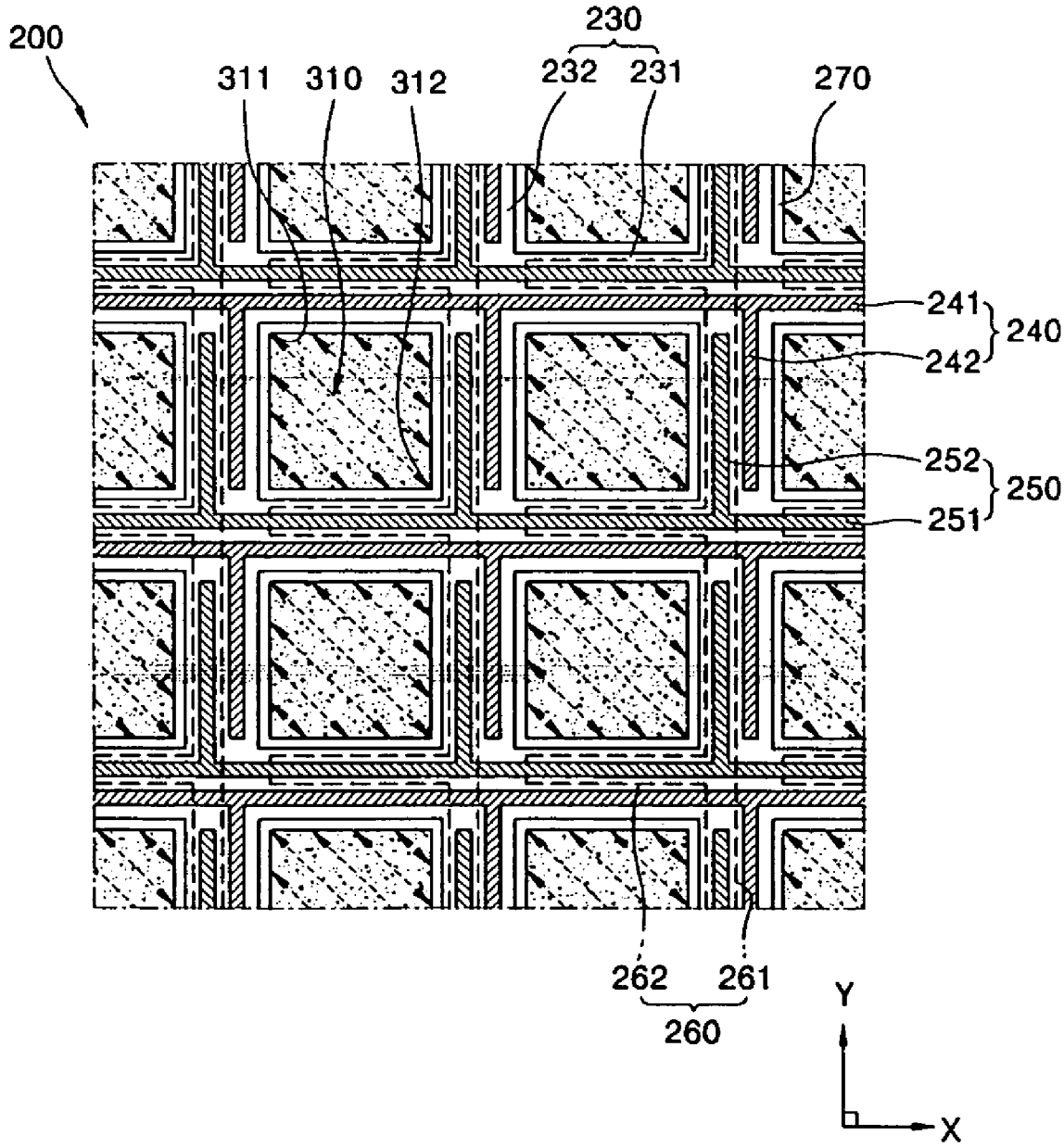
FIG. 3 is a plan view of an arrangement of discharge electrodes shown in FIG. 2.
Figure 4:
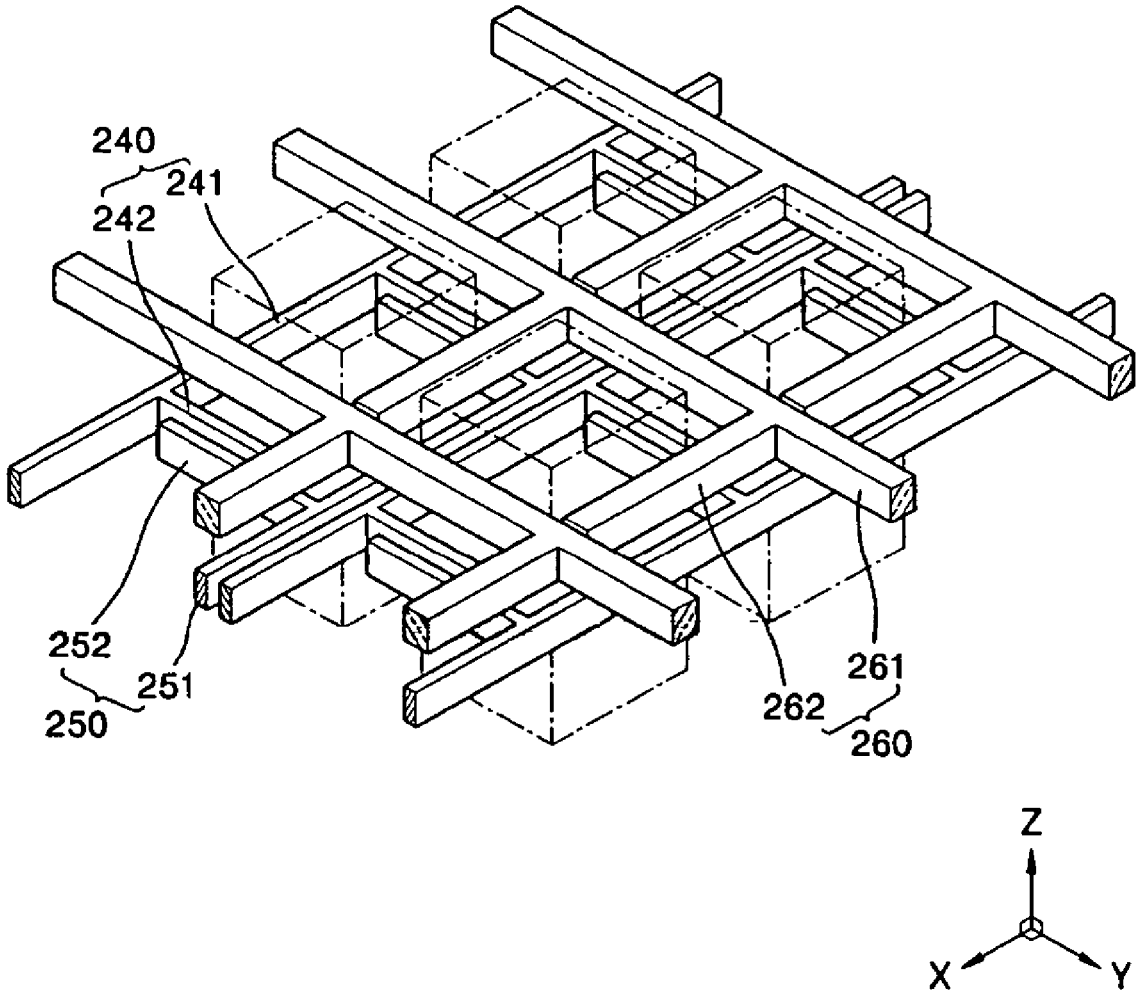
FIG. 4 is an exploded perspective view of the discharge electrodes of FIG. 2.

FIG. 3 is a plan view of the discharge electrodes of FIG. 2, and FIG. 4 is a perspective view of the discharge electrodes of FIG. 3.

Referring to FIGS. 3 and 4, on the plasma display panel 200, dielectric wall 231 is disposed in the X direction, and dielectric wall 232 is disposed in the Y direction. The discharge cell 310 formed by coupling dielectric walls 231 and 232 is formed as a square, and the discharge cells 310 are disposed continuously in the X and Y directions arranged at predetermined intervals from each other.

The X electrode 240 is embedded within the dielectric layer 230. The X electrode 240 is arranged to span first corners 311 of the discharge cells 310. In addition, the X electrode 240 includes an X electrode line 241 disposed in the X direction of the discharge cell 310. The X electrode line 241 is formed as a strip, and one strip is disposed at each first dielectric wall 231.

An X electrode protrusion 242 is connected to the X electrode line 241 in the Y direction of the discharge cell 310. The length of the X electrode protrusion 242 corresponds to the side of the discharge cell 310 in the Y direction. One or more X electrode protrusions 242 are disposed at each second dielectric wall 232. According to this arrangement the X electrode 240 has a general shape of a comb. Other general shapes may be used.

The Y electrode 250 is embedded within the dielectric wall 230. The Y electrode 250 is arranged to span second corners 312 which, with respect to individual cells, are opposite the first corners 311. The Y electrode 250 includes a Y electrode line 251 disposed in the X direction of the discharge cell 310. The Y electrode line 251 is formed as a strip, and one strip is disposed at each first dielectric wall 231.

A Y electrode protrusion 252 is connected to the Y electrode line 251 in the Y direction of the discharge cell 310. The length of the Y electrode protrusion 252 corresponds to the side of the discharge cell 310 in the Y direction. One or more Y electrode protrusions 252 are disposed at each second dielectric wall 232. According to this arrangement the Y electrode 250 has a general shape of a comb. Other general shapes may be used.

In addition, the X and Y electrodes 240 and 250 are disposed so that the X electrode protrusion 242 and the Y electrode protrusion 252 are each on a separate side of the discharge cell 310. This occurs from the arrangement that the X and Y electrodes are generally shaped as combs with the protrusions interleaved.

With reference to an individual discharge cell the Y electrode line 251 spans the opposite corner as the X electrode line 241. This arrangement allows for the electrode lines 241 and 251 to sustain the discharge at each discharge cell 310.

The address electrode 260 is also embedded within the dielectric wall 230. The address electrode 260 is generally positioned above the Y electrode 250. The address line 261 is formed as a strip. One address electrode line 261 is disposed at each second dielectric wall 232.

An address electrode protrusion 262 is integrally connected to the address electrode line 261. The address electrode protrusion 262 is disposed in parallel to the Y electrode line 251 and at a position corresponding to the Y electrode line 251. The address electrode line 261 and the address electrode protrusion 262 extending from the side wall of the address electrode line 261 have a general comb shape, but other shapes may be used.

The X electrode 240, the Y electrode 250, and the address electrode 260 are disposed along the perimeter of the discharge cell 310. Therefore, the X, Y, and the address electrodes 240, 250, and 260 do not affect the aperture rate of the panel 200, and thus, these electrodes 240, 250, and 260 can be formed of an opaque material having high conductivity such as Ag paste, or Cr—Cu—Cr.

Figure 5:
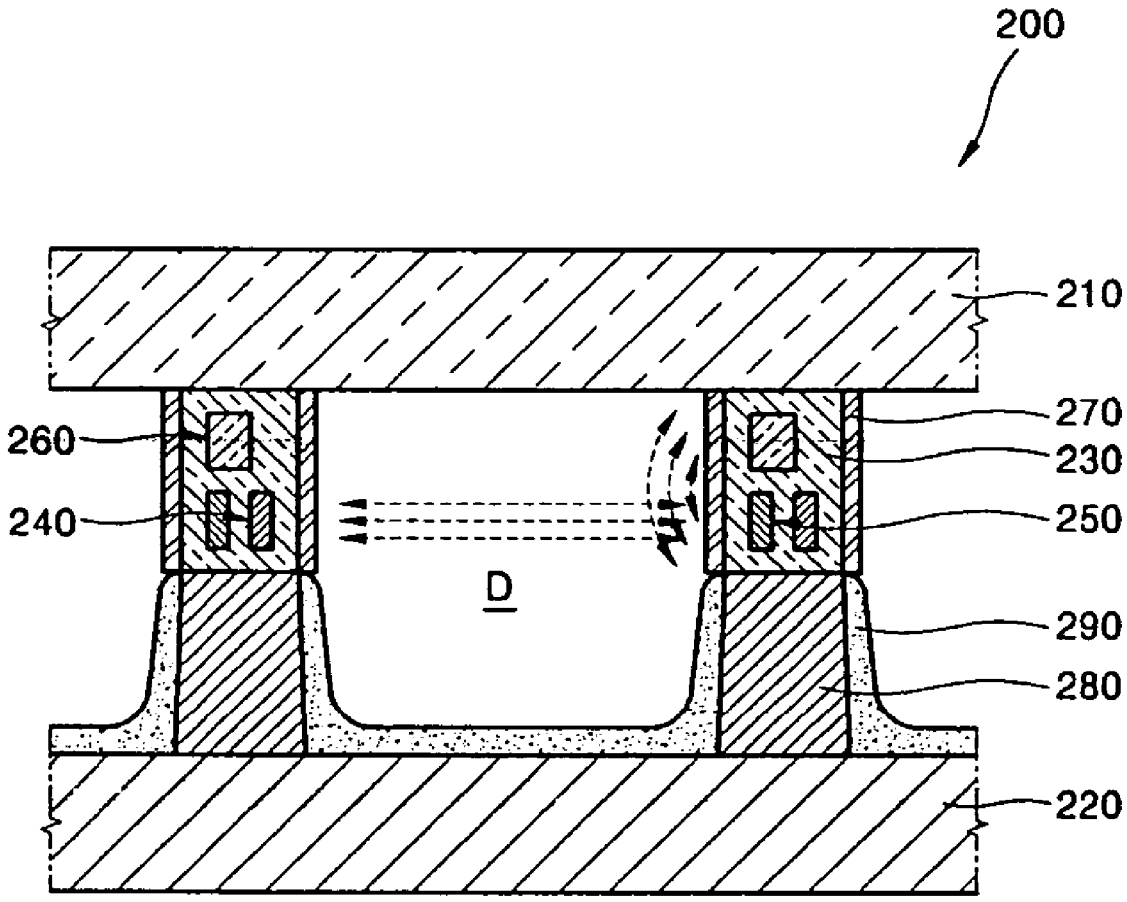
FIG. 5 is a cross-sectional view of the panel taken along line I-I where the panel of FIG. 2 is not exploded.

Operations of the plasma display panel 200 having the above structure will be described with reference to FIG. 5 showing the plasma display panel taken along line I-I of FIGS. 2 and 3.

When a predetermined pulse voltage is applied between the address electrode 260 and the Y electrode 250 from external power source, a discharge cell 310 is selected. Wall charges are accumulated on the inner side surfaces of the selected discharge cell 310 between the address electrode 260 and the Y electrode 250.

Because the distance between the address electrode 260 and the Y electrode 250 is shorter than that in the conventional art, the pulse voltage applied between the address electrode 260 and the Y electrode 250 to generate the discharge can be lower than that of the conventional art. In addition, the addressing speed between the address electrode 260 and the Y electrode 250 is increased.

In addition, when a positive voltage is applied to the X electrode 240 and still higher voltage is applied to the Y electrode 250, the wall charges move due to the difference between the voltages applied to the X and Y electrodes 240 and 250.

The wall charges collide with discharge gas atoms in the discharge cell 310 to generate a discharge and generate plasma. The discharge starts from the first corner 311 and the second corner 312 and moves to the center of the discharge cell 310.

After generating the discharge, when the voltage difference between the X electrode 240 and the Y electrode 250 becomes lower than the discharge voltage, the discharge ceases, and space charges and wall charges form in the discharge cell 310. If the polarities of voltages applied to the X and Y electrodes 240 and 250 are changed, the discharge occurs again with help of the wall charges. When the above process is successively repeated the discharge can occur stably.

The ultraviolet radiation generated by the discharge excites the phosphor materials of the phosphor layers 290 applied in the discharge cells 310. Through this process, the visible light is generated. The visible light is emitted from the discharge cell 310 to display a still image or moving picture image.

Figure 6:
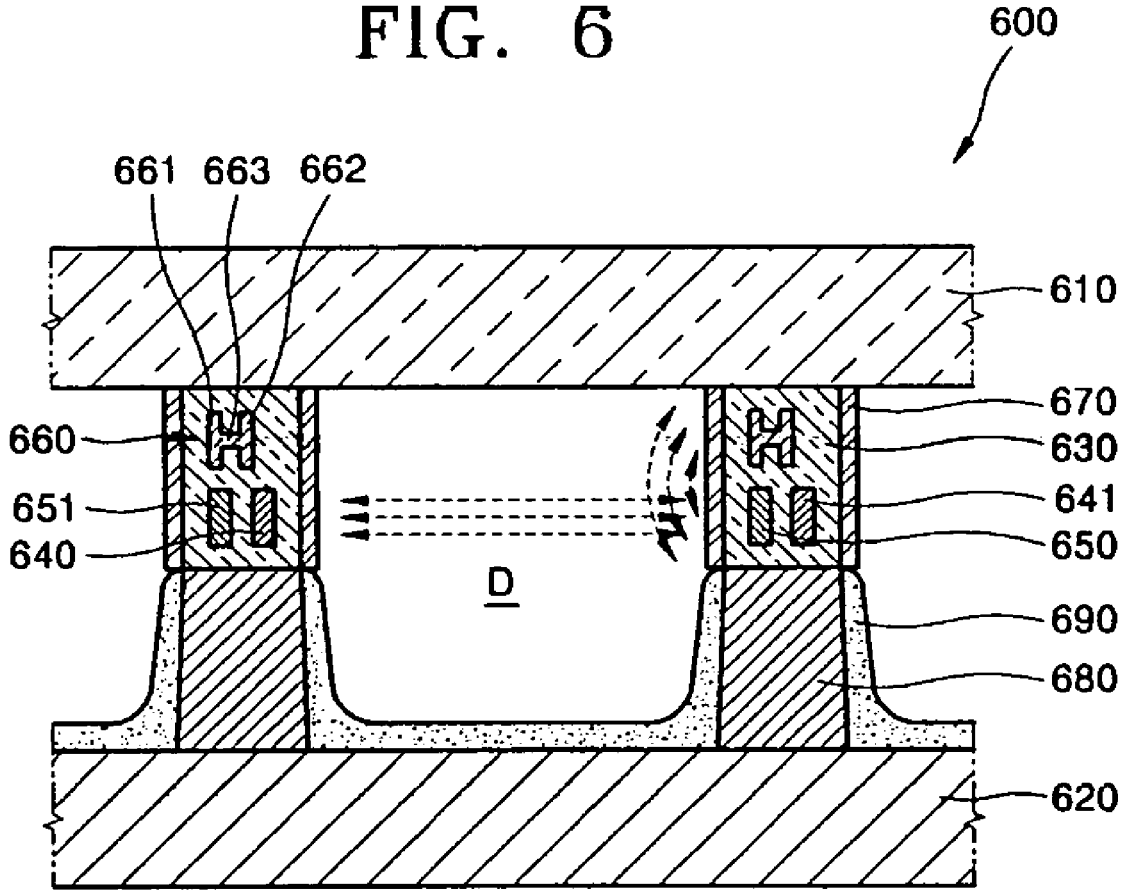
FIG. 6 is a cross-sectional view of a plasma display panel according to another embodiment.

FIG. 6 shows a plasma display panel 600 according to another embodiment.

Referring to FIG. 6, the plasma display panel 600 includes a front substrate 610 and a rear substrate 620. A dielectric wall 630 is disposed between the front substrate 610 and the rear substrate 620. A protective layer 670 is deposited on the side walls of the dielectric wall 630. A barrier rib 680 having a shape corresponding to the dielectric wall 630 is disposed between the dielectric wall 630 and the rear substrate 620. Red, green, or blue phosphor layers 690 are coated in the discharge cell 630.

In addition, a discharge gas such as Ne—Xe or He—Xe is injected into the discharge cell (D) defined by the front substrate 610, the rear substrate 620, the dielectric wall 630, and the barrier rib 680.

A plurality of discharge electrodes are embedded within the dielectric wall 630 along the perimeter of the discharge cell (D). A Y electrode 650 and an address electrode 660 are disposed in upper and lower portions, and the address electrode 660 has a structure designed for reducing electrical resistance.

At least a part of the address electrode 660 is formed to have larger volume than that of other parts in order to reduce the line resistance of the strip shaped electrode. The address electrode 660 includes a first address electrode portion 661, a second address electrode portion 662 separated a predetermined distance from the first address electrode portion 661, and a connection portion 663 integrally connecting the first address electrode portion 661 to the second address electrode portion 662. The first and second address electrode portions 661 and 662 are formed to have the same widths and lengths, and thus, have the same volume. The connection portion 663 connects the center portion of the first address electrode portion 661 to the center of the second address electrode portion 662. The address electrode 630 has a cross section of "H" shape by the first and second address electrode portions 661 and 662, and the connection portion 663 connecting the two address electrode portions 661 and 662.

The address electrode 630 can be designed in various other shapes, as well. The cross sectional area may vary across the surface of the panel. It may, for example be larger at the center of the panel than at the edges.

The relative positioning of the electrodes may be altered. For example, FIG. 7 shows a plasma display panel 700 according to another embodiment.

Figure 7:
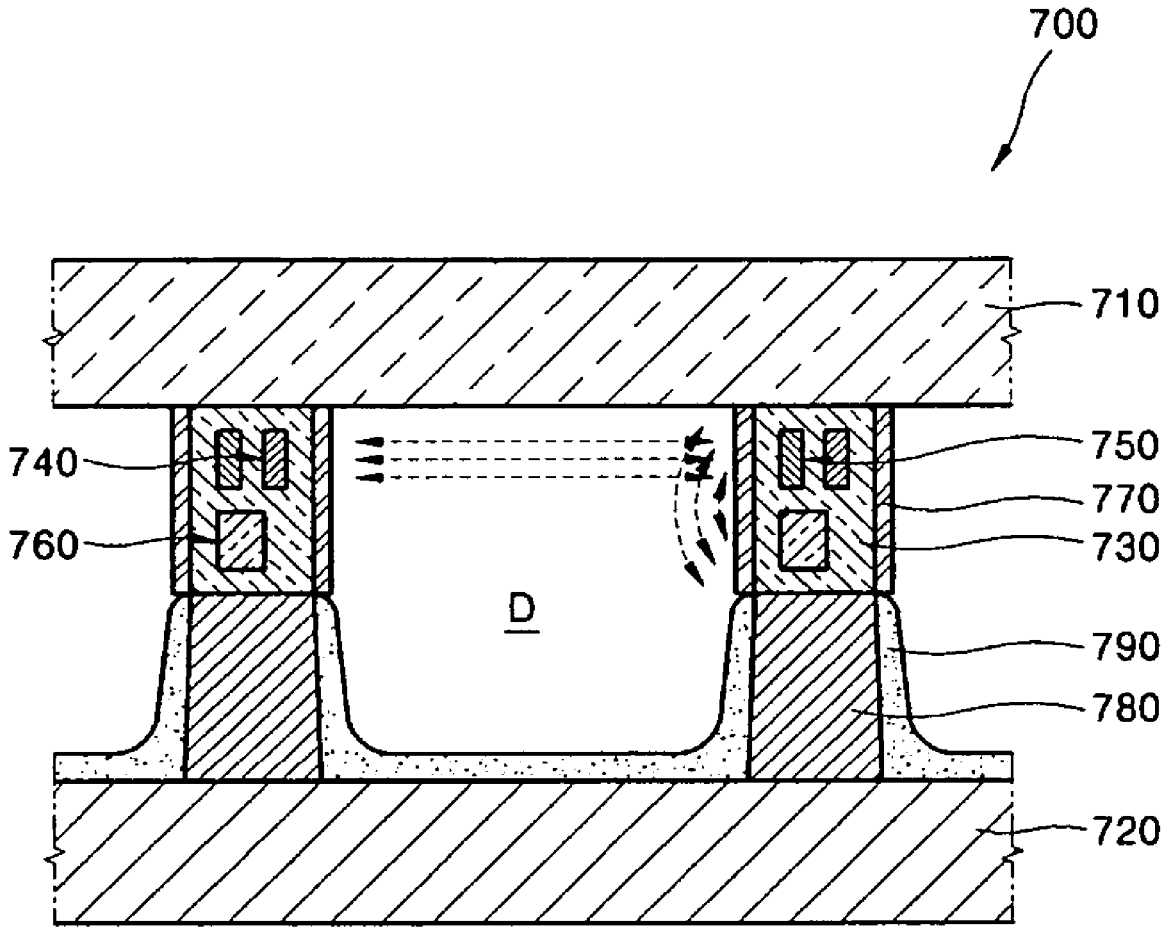
FIG. 7 is a cross-sectional view of a plasma display panel according to another embodiment.

Referring to FIG. 7, the plasma display panel 700 includes a front substrate 710 and a rear substrate 720. A dielectric wall 730 and a barrier rib 780 are disposed in upper and lower portions between the front and rear substrates 710 and 720 in order to define the discharge cell (D). Red, green, or blue phosphor layers 790 are applied to the inside of the barrier rib 780.

X and Y electrodes 740 and 750 are embedded within the dielectric wall 730 along opposing sides of the discharge cell (D), and span opposite corners of the discharge cell (D). An address electrode 760 is disposed under the Y electrode 750. The Y electrode 750 is adjacent to the front substrate 710, and the address electrode 760 is adjacent to the rear substrate 720.

In the plasma display panel 700 having the above structure pulse voltages are applied to the Y electrode 750 and the address electrode 760 in order to select the discharge cell (D) where discharge occurs. Functionality of the cell is otherwise analogous to that described with regard to other embodiments.

As described above, the plasma display panel having the discharge electrodes of improved structure can have at least following benefits.

Since the discharge can occur along the side surfaces of the discharge cell, the discharge area can be increased.

In addition, the discharge electrodes, the dielectric layer, and the protective layer are not formed on the surface of the substrate, through which the visible light is transmitted, and thus, the aperture rate of the panel can be improved greatly.

Since the discharge starts from the corners of the discharge cell and moves to the center, the discharge efficiency is increased. Because the paths of ions are parallel to the phosphor layer in the sustained discharge, the ion sputtering of the phosphor layer is substantially prevented.

In addition, since the Y electrode and the address electrode are embedded within the dielectric layer arranged adjacent to each other, the distance between the electrodes can be reduced, and low voltage operating and high speed addressing is achieved.

While the above description has pointed out novel features of the invention as applied to various embodiments, the skilled person will understand that various omissions, substitutions, and changes in the form and details of the device or process illustrated may be made without departing from the scope of the invention. Therefore, the scope of the invention is defined by the appended claims rather than by the foregoing description. All variations coming within the meaning and range of equivalency of the claims are embraced within their scope.

What is claimed is:

1. A plasma display panel comprising:

a front substrate;

a rear substrate facing the front substrate;

a dielectric wall positioned between the front and rear substrates and defining discharge cells with the front and rear substrates;

an X electrode embedded within the dielectric wall and positioned to span a first corner of one of the discharge cells;

a Y electrode embedded within the dielectric wall and positioned to span a second corner of one of the discharge cells, the second corner being opposite the first corner, wherein the Y electrode and the X electrode are substantially planar and are substantially in the same plane;

an address electrode embedded within the dielectric layer, and positioned so as to cross the Y electrode; and red, green, or blue phosphor layers applied in each of the discharge cells, wherein the address electrode is positioned substantially within a second plane separate from and parallel to the first plane and the address electrode is positioned substantially adjacent to the X and Y electrodes, wherein the X electrode extends in a predetermined direction, and the Y electrode extends in a direction parallel to a side of the discharge cell and to the X electrode, and the X electrode comprises an X electrode line and an X electrode protrusion extending from the X electrode line toward the Y electrode, the X electrode protrusion extending substantially in the same plane as the X electrode.

2. The plasma display panel of claim 1, wherein the Y electrode comprises a Y electrode line, and a Y electrode protrusion protruding from the Y electrode line toward the X electrode, the Y electrode protrusion extending substantially in the same plane as the Y electrode.

3. The plasma display panel of claim 1, wherein each of the X and Y electrodes are substantially formed in the shape of a comb and protrusions of each are interleaved with protrusions of the other.

4. The plasma display panel of claim 1, wherein the address electrode is parallel to the Y electrode protrusion.

5. The plasma display panel of claim 4, wherein the address electrode comprises an address electrode protrusion parallel to the Y electrode line.

6. The plasma display panel of claim 5, wherein the address electrode has the general shape of a comb and crosses the Y electrode.

7. The plasma display panel of claim 1, wherein at least one part of the address electrode has a larger volume than that of other parts.

8. The plasma display panel of claim 1, wherein the address electrode is formed so that a cross sectional area of the address electrode is larger at the center of the panel than at the edges.

9. The plasma display panel of claim 1, further comprising a barrier rib formed in a shape corresponding to the dielectric wall between the dielectric wall and the rear substrate, wherein the phosphor layer is applied on the inside of the barrier rib.

10. The plasma display panel of claim 9, wherein a protective layer is further formed on an inner surface of the dielectric wall in order to increase emission of secondary electrons.

* * * * *